US005491544A

United States Patent [19]

Kenin et al.

[11] Patent Number: 5,491,544

[45] Date of Patent: Feb. 13, 1996

[54] MOUNTING MECHANISM FOR A ROLLER TRANSFER ASSEMBLY

[76] Inventors: Michael Kenin; Steven L. Moore; Larry T. Schlitzer; Michael J. Wendell, all of Eastman Kodak Company, Rochester, N.Y. 14650

[21] Appl. No.: 330,491

[22] Filed: Oct. 28, 1994

[51] Int. Cl.[6] ..... G03G 15/14; G03G 15/16

[52] U.S. Cl. ..... 355/271; 355/274

[58] Field of Search ..... 355/219, 271, 355/274

[56] References Cited

U.S. PATENT DOCUMENTS

| | | | |
|---|---|---|---|
| 3,612,677 | 10/1971 | Langdon et al. | 355/326 |
| 3,685,896 | 8/1972 | Kaupp | 355/272 |
| 3,848,204 | 11/1974 | Draugelis et al. | 355/277 |
| 4,257,700 | 3/1981 | Tsuda et al. | 355/272 |
| 4,260,236 | 4/1981 | Tsuda et al. | 355/274 |
| 4,302,093 | 11/1981 | Landa | 355/274 |
| 5,101,238 | 3/1992 | Creveling et al. | 355/271 |
| 5,126,796 | 6/1992 | Fujii et al. | 355/271 |
| 5,138,372 | 8/1992 | DeCecca | 355/200 |
| 5,248,027 | 9/1993 | Kluger et al. | 198/502.4 |

*Primary Examiner*—William J. Royer
*Attorney, Agent, or Firm*—Lawrence P. Kessler

[57] ABSTRACT

In an electrostatographic reproduction apparatus having a transfer assembly, of compact configuration, including a transfer roller for effecting transfer of a pigmented marking particle image from a dielectric support to a receiver member including a mechanism for mounting the roller transfer assembly. The mechanism includes a support for the transfer assembly located within the reproduction apparatus. The support for the transfer assembly is connected to the transfer assembly such that the transfer roller of the transfer assembly is castered and gimbaled.

8 Claims, 2 Drawing Sheets

MOUNTING MECHANISM FOR A ROLLER TRANSFER ASSEMBLY

BACKGROUND OF THE INVENTION

This invention relates in general to a transfer assembly for use for example in an electrostatographic reproduction apparatus, and more specifically to a mounting mechanism for a roller transfer assembly which is readily movable to an operative or inoperative position within the reproduction apparatus.

In modern high speed/high quality electrostatographic reproduction apparatus (copier/duplicators or printers), a latent image charge pattern is formed on a uniformly charged dielectric support member. Pigmented marking particles are attracted to the latent image charge pattern to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member while in contact with the dielectric support, or by an electrically biased roller urging the receiver member against the dielectric support. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support is remarkably efficient in providing intimate uniform contact therebetween. However, roller transfer apparatus are more complex than corona transfer apparatus in that they require cleaning due to their tendency to pick up marking particles from the dielectric support and undesirably deposit such particles on the back side of the receiver member. Further, the roller transfer apparatus, including their cleaning assemblies must be constructed so as not to interfere with ready clearance of any jammed receiver members. An example of a selectively positionable roller transfer apparatus constructed to include a cleaning mechanism is shown in U.S. Pat. No. 5,101,238 (issued Mar. 31,1992, in the names of Creveling, et al). While such roller transfer apparatus is generally effective in carrying out desired marking particle image transfer, it tends to impose undesirable tracking effects on the photoconductive web.

SUMMARY OF THE INVENTION

This invention is directed to an electrostatographic reproduction apparatus having a transfer assembly, of compact configuration, including a transfer roller for effecting transfer of a pigmented marking particle image from a dielectric support to a receiver member including a mechanism for mounting the roller transfer assembly. The mechanism comprises a support for the transfer assembly located within the reproduction apparatus. The support for the transfer assembly is connected to the transfer assembly such that the transfer roller of the transfer assembly is castered and gimbaled.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
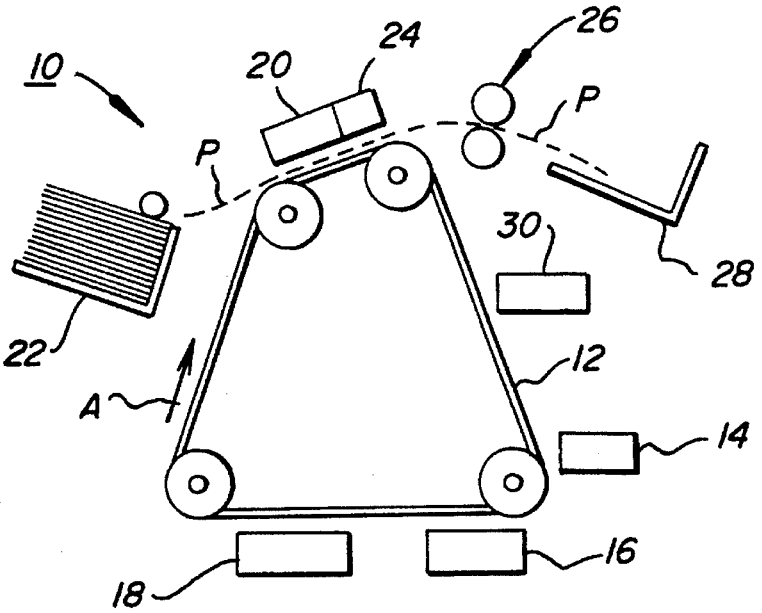
FIG. 1 is a schematic illustration of a typical electrostatographic reproduction apparatus suitable for utilizing the roller transfer assembly according to this invention.

Referring now to the accompanying drawings, FIG. 1 schematically illustrates a typical electrostatographic reproduction apparatus 10 suitable for utilizing an exemplary roller transfer assembly such as shown and described in aforementioned U.S. Pat. No. 5,101,238. The reproduction apparatus 10, described herein only to the extent necessary for a complete understanding of this invention, includes a dielectric support 12. The dielectric support 12 is, for example, in the form of an endless web mounted on support rollers and movable about a closed loop path in the direction of arrow A through a series of electrographic process stations.

In the reproduction cycle for the reproduction apparatus 10, the moving dielectric support 12 is uniformly charged as it moves past a charging station 14. Thereafter the uniformly charged dielectric support passes through an exposure station 16 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support to a reflected light image of an original document to be reproduced or "writing" on the dielectric support with a series of lamps (e.g., LED's or lasers) or point electrodes activated by electronically generated signals based on the desired information to be reproduced. The latent image charge pattern on the dielectric support 12 is then brought into association with a development station 18 which applies pigmented marking particles to adhere to the dielectric support to develop the latent image. The portion of the dielectric support carrying the developed image then passes through a transfer station 20 in register with a receiver member fed in proper timed relation from a supply hopper 22 along the path P. An electric field produced in the transfer station attracts the marking particle of the developed image from the dielectric support to the receiver member.

The electric transfer field may also cause the receiver member to adhere to the dielectric support. Accordingly, a detack mechanism 24, immediately downstream in the direction of travel of the dielectric support, is provided to facilitate removal of the receiver member from the dielectric support. The detack mechanism may be, for example, an AC corona charger for neutralizing the attractive field holding the receiver member to the dielectric support. After the developed image is transferred to the receiver member and the receiver member is separated from the dielectric support, the receiver member is transported through a fusing device 26 where the image is fixed to the receiver member by heat and/or pressure for example, and delivered to an output hopper 28 for operator retrieval. Simultaneously, the dielectric support 12 is cleaned of any residual marking particles at cleaning station 30 and returned to the charging station 14 for reuse.

Figure 2:
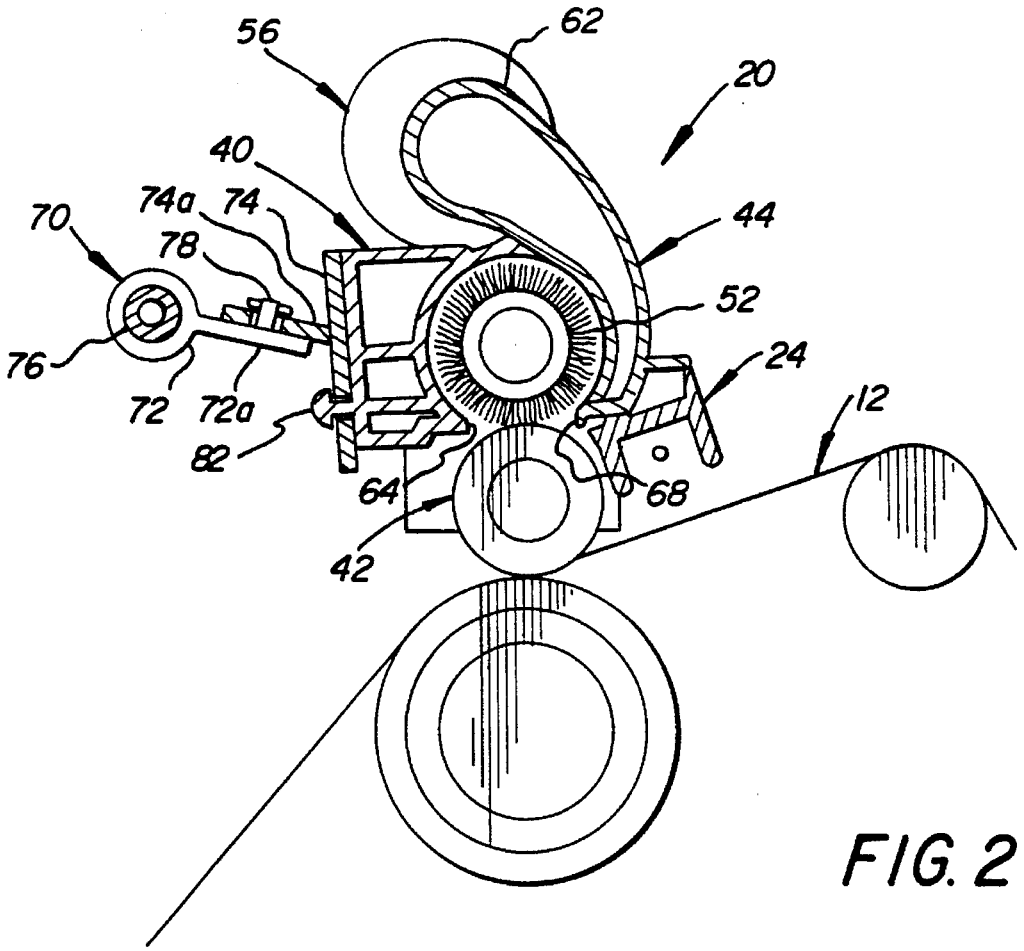
FIG. 2 is a front elevational view, partly in cross-section, of a roller transfer assembly including a mounting mechanism according to this invention.

Turning now to the exemplary transfer station 20, as noted above such station is for example a roller transfer assembly which is described hereinbelow with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detack mechanism 24 in a compact configuration. An electrical bias is applied to the core of the roller 42 from a voltage limited constant current power supply (not shown). As such, when the transfer roller is in operative association with the dielectric support 12 (as shown in FIG. 2), an electrical transfer field is established which will efficiently transfer a marking particle developed image from the dielectric support to a receiver member passing therebetween.

When the transfer roller 42 contacts the dielectric support 12 with no receiver member therebetween, the transfer roller tends to pick up residual marking particles from the dielectric support. On subsequent passes of receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62. The vacuum air flow system 62, in flow communication with a vacuum blower (not shown), forms an air flow directing chamber about the brush 52. The air flow chamber provides an air flow passage wrapping about a portion of the brush 52 with an opening 64 to the brush located adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The detack mechanism 24 of the roller transfer assembly is preferably an AC corona charger interconnected with the unitary housing 40. The detack mechanism 24 is located such that when the roller transfer assembly 20 is in operative association with the dielectric support 12, the detack charger is located downstream (in the direction of dielectric support travel) from the transfer roller 42 to effectively provide a field which relieves the electrostatic attraction forces between the receiver member and the dielectric support. In this manner, the receiver member is readily detacked from the dielectric support for transport along its intended path P to the fusing device 26 (FIG. 1 ) without interference or jamming.

Figure 4:
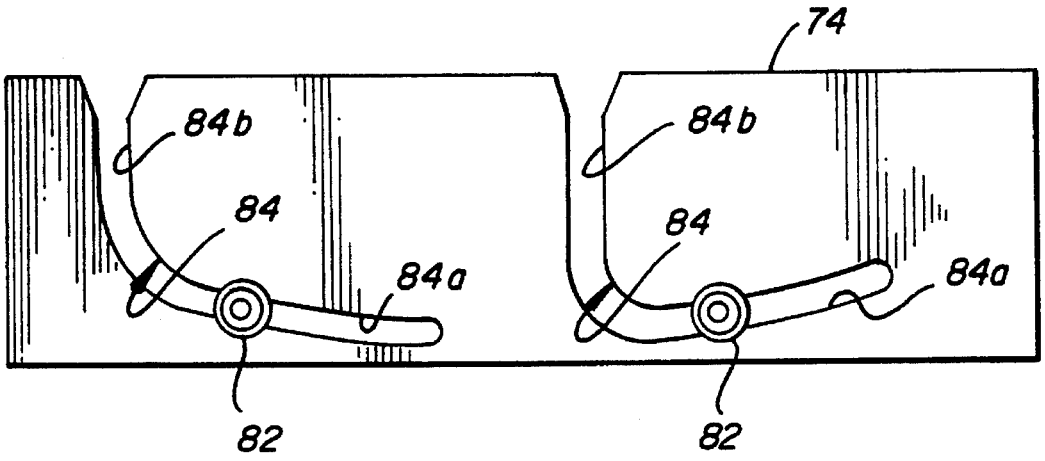
FIG. 4 is an end elevational view of the transfer roller mounting mechanism of FIG. 2, with portions removed to facilitate viewing.
Figure 3:
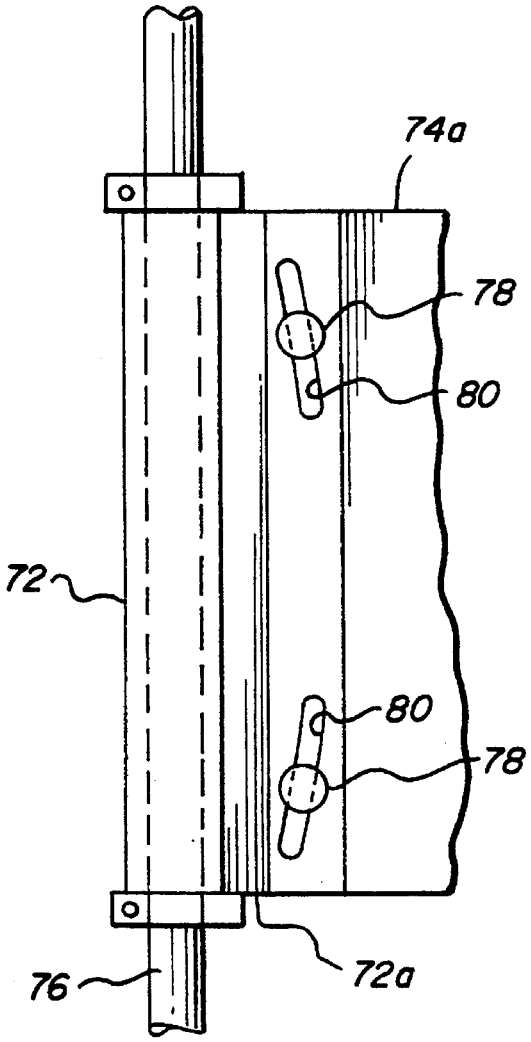
FIG. 3 is a top elevational view of the transfer roller mounting mechanism of FIG. 2, with portions removed to facilitate viewing.

With the compact arrangement for the roller transfer assembly described above, a mounting, designated generally by the numeral 70, is provided according to this invention. The mounting 70 enables the roller transfer assembly to contact the dielectric support 12 in a manner so as to impart no steering forces to the moving support. Accordingly, as best shown in FIGS. 2–4, the mounting 70 for the roller transfer assembly includes a bracket 72, a yoke 74, and a support shaft 76. The shaft 76 is located within the reproduction apparatus 10 in association with the dielectric support 12. The bracket 72 is supported on the shaft 76, at a fixed location in the direction of the longitudinal axis of the shaft, and for rotation about the longitudinal axis of the shaft (see FIG. 3). The yoke 74 is, in turn, connected to the bracket 72 and the housing 40 of the roller transfer assembly in a manner such that the transfer roller is castered and gimbaled.

The bracket 72 has a radially extending ann 72*a*. A pair of pins 78 extend substantially perpendicularly from the arm 72*a*. The yoke 74 has a branched plate 74*a* extending substantially perpendicularly therefrom. A pair of slots 80 formed in the plate 74*a* are adapted to respectively receive the pins 78. Accordingly, the yoke 74 is supposed for movement relative to the bracket 72 by means of the pin-in-slot connection therebetween (see FIG. 3). Since the slots are arcuately shaped at a preselected radius, movement of the yoke 74 along the arc results in movement of the housing 40 to provide a castering motion for the transfer roller 42.

The connection of the yoke 74 to the housing 40 is of similar approach. That is, the housing 40 has a pair of pins 82 extending substantially perpendicularly from the housing. A pair of slots 84, adapted to respectively receive the pins 82, are formed in the main body of the yoke 74 (see FIG. 4). The slots 84 respectively have an arcuate portion 84*a* and a portion 84*b* extending from the arcuate portion to the marginal edge of the yoke. By such arrangement, the installation (or removal) of the roller transfer assembly is readily facilitated. On installation, the yoke 74 is positioned so that the pins 82 enter portions 84*b*, and thereafter the yoke is moved such that the pins are located in portions 84*a* (removal being accomplished by reversal of the installation steps). Accordingly, the housing 40, and thus the transfer roller 42, is supported for movement relative to the yoke 74 by means of the pin-in-slot connection therebetween (see FIG. 4). Since the slots are arcuately shaped at a preselected radius, movement of the housing along the arc provides a gimbaling motion for the transfer roller 42.

The castering and gimbaling of the transfer roller substantially eliminate unwanted reaction forces on the dielectric member by the transfer roller 42 which would result from otherwise over constraining the movement of the transfer roller. Accordingly, the quality of the reproductions will be both better and more consistent in that they will have less artifacts. Furthermore, there will be less wear on the dielectric support so as to improve its life, and the dielectric support will be less subject to crashes due to improper steering effects otherwise induced by the transfer roller.

The invention has been described in detail with particular reference to preferred embodiment thereof, but it will be understood that variations and modifications can be effected within the spirit and scope of the invention.

We claim:

1. In an electrostatographic reproduction apparatus having a transfer assembly, of compact configuration, including an electrically biased transfer roller for effecting transfer of a pigmented marking particle image from a dielectric support to a receiver member, a mechanism for mounting said transfer assembly, said mechanism comprising:

means for supporting said transfer assembly within said reproduction apparatus; and means for connecting said transfer assembly supporting means to said transfer assembly such that said transfer roller of said transfer assembly is castered and gimbaled.

2. The mechanism for mounting said transfer assembly of claim 1 wherein said means for connecting said supporting means to said transfer assembly includes a yoke engageable with said supporting means for relative movement thereto, and engageable with said transfer assembly for relative movement thereto.

3. The mechanism for mounting said transfer assembly of claim 2 wherein said means for supporting said transfer assembly includes a shaft, and a bracket mounted on said shaft.

4. The mechanism for mounting said transfer assembly of claim 3 wherein said bracket of said means for supporting said transfer assembly includes an arm carrying a pair of pins, and said yoke of said connecting means includes a pair of arcuate slots adapted to respectively receive said pins.

5. The mechanism for mounting said transfer assembly of claim 3 wherein said transfer assembly carries a pair of pins, and said yoke of said connecting means includes a pair of arcuate slots adapted to respectively receive said pins.

6. The mechanism for mounting said transfer assembly of claim 3 wherein said bracket includes an ann carrying a first pair of pins, and said yoke includes a first pair of arcuate slots adapted to respectively receive said first pair of pins, and wherein said transfer assembly carries a second pair of pins, and said yoke includes a second pair of arcuate slots adapted to respectively receive said second pair of pins.

7. The mechanism for mounting said transfer assembly of claim 6 wherein said yoke includes a main body in which said second pair of arcuate slots are defined, and a branched arm in which said first pair of arcuate slots are defined.

8. The mechanism for mounting said transfer assembly of claim 7 wherein said branched arm of said yoke is substantially perpendicular to said main body thereof.

* * * * *